US009194222B2

(12) United States Patent
Clarkson et al.

(10) Patent No.: US 9,194,222 B2
(45) Date of Patent: Nov. 24, 2015

(54) SYSTEM AND METHOD FOR IMPROVED PROPPED FRACTURE GEOMETRY FOR HIGH PERMEABILITY RESERVOIRS

(75) Inventors: Brad A. Clarkson, Fulshear, TX (US); Harvey J. Fitzpatrick, Katy, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1027 days.

(21) Appl. No.: 13/089,847

(22) Filed: Apr. 19, 2011

(65) Prior Publication Data

US 2012/0267104 A1 Oct. 25, 2012

(51) Int. Cl.

| | |
|---|---|
| ***G01V 3/34*** | (2006.01) |
| ***G01V 3/18*** | (2006.01) |
| ***G01V 3/11*** | (2006.01) |
| ***G01V 3/38*** | (2006.01) |
| ***E21B 43/267*** | (2006.01) |

(52) U.S. Cl.
CPC ..... *E21B 43/267* (2013.01)

(58) Field of Classification Search
CPC ..... E21B 7/00
USPC ..... 702/9, 10, 111, 12, 179, 182, 183; 166/280.1; 175/72; 507/124
IPC ..... G01V 1/00; E21B 1/00
See application file for complete search history.

(56) References Cited

U.S. PATENT DOCUMENTS

| | | | | |
|---|---|---|---|---|
| 4,848,461 | A * | 7/1989 | Lee | 166/250.1 |
| 5,005,643 | A * | 4/1991 | Soliman et al. | 166/250.1 |
| 5,325,921 | A * | 7/1994 | Johnson et al. | 166/280.1 |
| 6,076,046 | A * | 6/2000 | Vasudevan et al. | 702/12 |
| 6,795,773 | B2 | 9/2004 | Soliman et al. | |
| 7,207,386 | B2 * | 4/2007 | Brannon et al. | 166/280.2 |
| 7,392,843 | B2 * | 7/2008 | Ortiz et al. | 166/280.1 |
| 7,398,826 | B2 * | 7/2008 | Hoefer et al. | 166/280.1 |
| 7,451,812 | B2 * | 11/2008 | Cooper et al. | 166/250.1 |
| 2003/0054962 | A1 * | 3/2003 | England et al. | 507/117 |

OTHER PUBLICATIONS

Brannon et al., "Breaker Concentrations Required to Improve the Permeability of Proppant Packs Damaged by Concentrated Linear and Borate-Crosslinked Fracturing Fluids," SPE 20135, Mar. 1990.
Oberwinkler et al., "The Definitive Identification of Candidate Wells for Refracturing," SPE 84211, Oct. 2003.

(Continued)

*Primary Examiner* — John Breene
*Assistant Examiner* — Felix Suarez
(74) *Attorney, Agent, or Firm* — McDermott Will & Emery LLP; Holly Soehnge

(57) ABSTRACT

Systems and methods for improved propped fracture geometry for high permeability reservoirs are provided. In one embodiment, a method of determining a pad volume and proppant volume for fracturing a subterranean formation is provided comprising selecting a proppant volume for placement in a fracture to be created in a subterranean formation; determining a desired fracture geometry for the fracture; calculating a pad volume sufficient to create the desired fracture geometry in the subterranean formation at a lower fluid efficiency value; calculating a fracture length that would result from injecting the pad volume into the subterranean formation at an upper fluid efficiency value; calculating a fracture width that corresponds to the calculated fracture length; and calculating a proppant volume sufficient to fill a fracture having the calculated length and width.

20 Claims, 2 Drawing Sheets

(56) References Cited

OTHER PUBLICATIONS

Economides et al., "Unified Fracture Design: Bridging the Gap Between Theory and Practice," 2002.
Korovaychuk, Yaroslaw, "Fracturing Optimization: Pushing the Limits," TNK-BP Technology Monthly Newsletter, Feb. 2006, vol. 6.
Meyer, Bruce R., "Method Optimized Frac Performance," The American Oil Gas Reporter, 2005.
International Search Report and Written Opinion for PCT/GB2012/000310 dated Mar. 6, 2013.
Nolte, K.G., "Determination of Proppant and Fluid Schedules from Fracturing-Pressure Decline," SPE Production Engineering, vol. 1, No. 4, Jul. 1, 1986, XP055054046.
FracPac-N Fracture Design Service for High Perm Formations, XP055054049, Retrieved from the Internet: URL:http://www.halliburton.com/public/pe/contents/Data_Sheets/web/H/H07172.pdf, retrieved on Feb. 20, 2013.
Valko, Dr. Peter P., "Hf2D Frac Design Spreadsheet," XP055054056, Retrieved from the Internet: URL:http://www.pe.tamu.edu/valko/public_html/Hydraulic_Fracture_Design/xls/Hf2D/HF2D 06.doc, retrieved on Feb. 20, 2013.
Van et al., "Proppant Concentration in and Final Shape of Fractures Generated by Viscous Gels," Society of Petroleum Engineers Journal, vol. 14, No. 6, Dec. 1, 1974.
Official Action for Canadian Patent Application No. 2,831,500 dated Sep. 10, 2015.

* cited by examiner

SYSTEM AND METHOD FOR IMPROVED PROPPED FRACTURE GEOMETRY FOR HIGH PERMEABILITY RESERVOIRS

BACKGROUND

The present invention relates to systems and methods for treating subterranean formations. More particularly, the present invention relates to systems and methods for improved propped fracture geometry for high permeability reservoirs.

Hydrocarbon-producing wells are often stimulated by hydraulic fracturing treatments. Hydraulic fracturing operations generally involve pumping a fracturing fluid into a well bore that penetrates a subterranean formation at a hydraulic pressure to create or enhance one or more cracks, or "fractures," in the subterranean formation. "Enhancing" one or more fractures in a subterranean formation, as that term is used herein, is defined to include the extension or enlargement of one or more natural or previously created fractures in the subterranean formation. The fracturing fluid may comprise particulates, often referred to as "proppant particulates," that are deposited in the fractures. The proppant particulates function, inter alia, to prevent the fractures from fully closing upon the release of hydraulic pressure, forming conductive channels through which fluids may flow to the well bore. After at least one fracture is created and the proppant particulates are substantially in place, the fracturing fluid may be "broken" (i.e., the viscosity of the fluid is reduced), and the fracturing fluid may be recovered from the formation.

Hydrocarbon-producing wells also may undergo gravel packing treatments, inter alia, to reduce the migration of unconsolidated formation particulates into the well bore. In gravel-packing treatments, a treatment fluid suspends particulates (commonly referred to as "gravel particulates") to be deposited in a desired area in a well bore, e.g., near unconsolidated or weakly consolidated formation zones, to form a gravel pack to enhance sand control. One common type of gravel-packing operation involves placing a sand control screen in the well bore and packing the annulus between the screen and the well bore with the gravel particulates of a specific size designed to prevent the passage of formation sand. The gravel particulates act, inter alia, to prevent the formation particulates from occluding the screen or migrating with the produced hydrocarbons, and the screen acts, inter alia, to prevent the particulates from entering the production tubing. Once the gravel pack is substantially in place, the viscosity of the treatment fluid may be reduced to allow it to be recovered.

In some situations, fracturing and gravel-packing treatments are combined into a single treatment (commonly referred to as "frac-pack" operations). In such "frac-pack" operations, the treatments are generally completed with a gravel pack screen assembly in place with the hydraulic fracturing treatment being pumped through the annular space between the casing and screen. In this situation, the hydraulic fracturing treatment ends in a screen-out condition, creating an annular gravel pack between the screen and casing. In other cases, the fracturing treatment may be performed prior to installing the screen and placing a gravel pack.

The effectiveness of hydraulic fracturing is often dependent on the dimensions of the resulting fracture. For example, the resulting fracture is ideally wide enough to allow produced fluids to flow from the reservoir into the well bore at a sufficient rate and long enough to penetrate enough of the reservoir to be fed by an adequate volume of fluid. If the fracture is too narrow, the fracture may be a bottleneck in the production of the fluid; if the fracture is too short, it may not be fed by an adequate volume of fluid from the reservoir.

Attempts have been made at optimizing the geometry of propped fractures in high-permeability formations applying a theory known as "unified fracture design." This theory attempts to optimize fracture design for a given volume of proppant using pseudo steady-state analysis. However, this methodology relies on having reliable information about the fluid efficiency for a specific fracturing treatment on a reservoir, which may be difficult to achieve, even with extensive diagnostic pumping. As used herein, the term "fluid efficiency" generally refers to the value obtained by dividing the volume of a fracture by the volume of fluid pumped into the fracture. Diagnostic pumping that is used to determine fluid efficiency may add unnecessary time and expense to the fracturing process and/or adversely affect the productivity of the reservoir. Also, by the nature of the fracturing process, fluid efficiency can change during the course of a fracturing treatment. One factor that can affect fluid efficiency is if fracture growth exposes formation layers or surfaces with varying properties. Another factor that can cause fluid efficiency to change during a treatment is changes in treating pressure within a formation. A third factor may be the nature of the fracture's penetration into the formation layers and the degree to which it is a simple single fissure or if the fracture's nature is more complex with multiple or branched fissures. A fourth, but not necessarily final, factor is the degree to which pressure in the fracture affects the porosity and permeability of the fracture face. Softer formations may have changing porosity and permeability along with altered mechanical properties caused by increasing pressure and fracturing fluid invasion.

SUMMARY

The present invention relates to systems and methods for treating subterranean formations. More particularly, the present invention relates to systems and methods for improved propped fracture geometry for high permeability reservoirs.

Some embodiments of the present invention provide methods of determining a pad volume and a proppant volume for fracturing a subterranean formation comprising: selecting an initial proppant volume for placement in a fracture to be created in the subterranean formation; determining a fracture geometry for the fracture, based upon the initial proppant volume; determining a pad volume sufficient to create the desired fracture geometry at a first fluid efficiency value; determining a fracture length and width that would result from injecting the pad volume into the subterranean formation at a second fluid efficiency value; and calculating a proppant volume sufficient to fill a fracture having the length and width; wherein the first fluid efficiency value is lower than the second fluid efficiency value.

Other embodiments of the present invention provide logic encoded in computer-readable media operable, when executed by one or more processors, to perform the steps comprising: selecting an initial proppant volume for placement in a fracture to be created in a subterranean formation; determining a fracture geometry for the fracture; determining a pad volume sufficient to create the fracture geometry at a first fluid efficiency value; determining a fracture length and width that would result from injecting the pad volume into the subterranean formation at a second fluid efficiency value; and calculating a proppant volume sufficient to fill a fracture having the length and width such that the resulting fracture conductivity is either the initial proppant volume, an optimum proppant volume, or an input parameter limited proppant volume; wherein the first fluid efficiency value is lower than the second fluid efficiency value.

Still embodiments of the present invention provide systems for calculating propped fracture geometry, comprising: a proppant number module operable to determine a fracture geometry for a fracture in a subterranean formation; a pad volume module operable to calculate a pad volume sufficient to create the fracture geometry at a first fluid efficiency value; and a proppant volume module operable to calculate a proppant volume sufficient to fill a fracture that would result from the calculated pad volume being injected into the subterranean formation at a second fluid efficiency value and obtain a fracture width; wherein the first fluid efficiency value is lower than the second fluid efficiency value.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DESCRIPTION OF PREFERRED EMBODIMENTS

The present invention relates to systems and methods for treating subterranean formations. More particularly, the present invention relates to systems and methods for improved propped fracture geometry for high permeability reservoirs.

In particular embodiments, the present invention provides a method of determining a pad volume and proppant volume for fracturing a subterranean formation comprising selecting a proppant volume for placement in a fracture to be created in a subterranean formation, determining a desired fracture geometry for the fracture, calculating a pad volume sufficient to create the desired fracture geometry in the subterranean formation at a lower fluid efficiency value, calculating a fracture length and width that would result from injecting the pad volume into the subterranean formation at an upper fluid efficiency value, and calculating a proppant volume sufficient to fill a fracture having the calculated length and width. In some embodiments, a fracture is then created in the subterranean formation using the calculated pad and proppant volumes. Also, in some embodiments, before a fracture is created, a pumping schedule is determined for the calculated pad and proppant volumes.

Generally, the systems and methods of the present invention allow one to obtain improved fracture geometry where the fluid efficiency for the subterranean formation falls within a predetermined range. In particular embodiments, this may reduce or eliminate the need for diagnostic pumping, reduce process steps, reduce gel volumes injected into the reservoir, and/or reduce damage to the productivity of the reservoir. While the systems and methods of the present invention are applicable to use in many types of subterranean formations, in some embodiments, the methods of the present invention may be particularly well suited for use in soft rock and/or high permeability rock formations. In some embodiments, the methods of the present invention may be used in combination with tip screen out hydraulic fracture stimulation treatments, such as FRACPAC™ service, available from Halliburton Energy Services of Duncan, Okla., tip screen out propped hydraulic fracture stimulation treatments, and screenless FRACPAC™ treatments in formations with permeability from about 1 mD to multiple darcies permeability.

Figure 1:
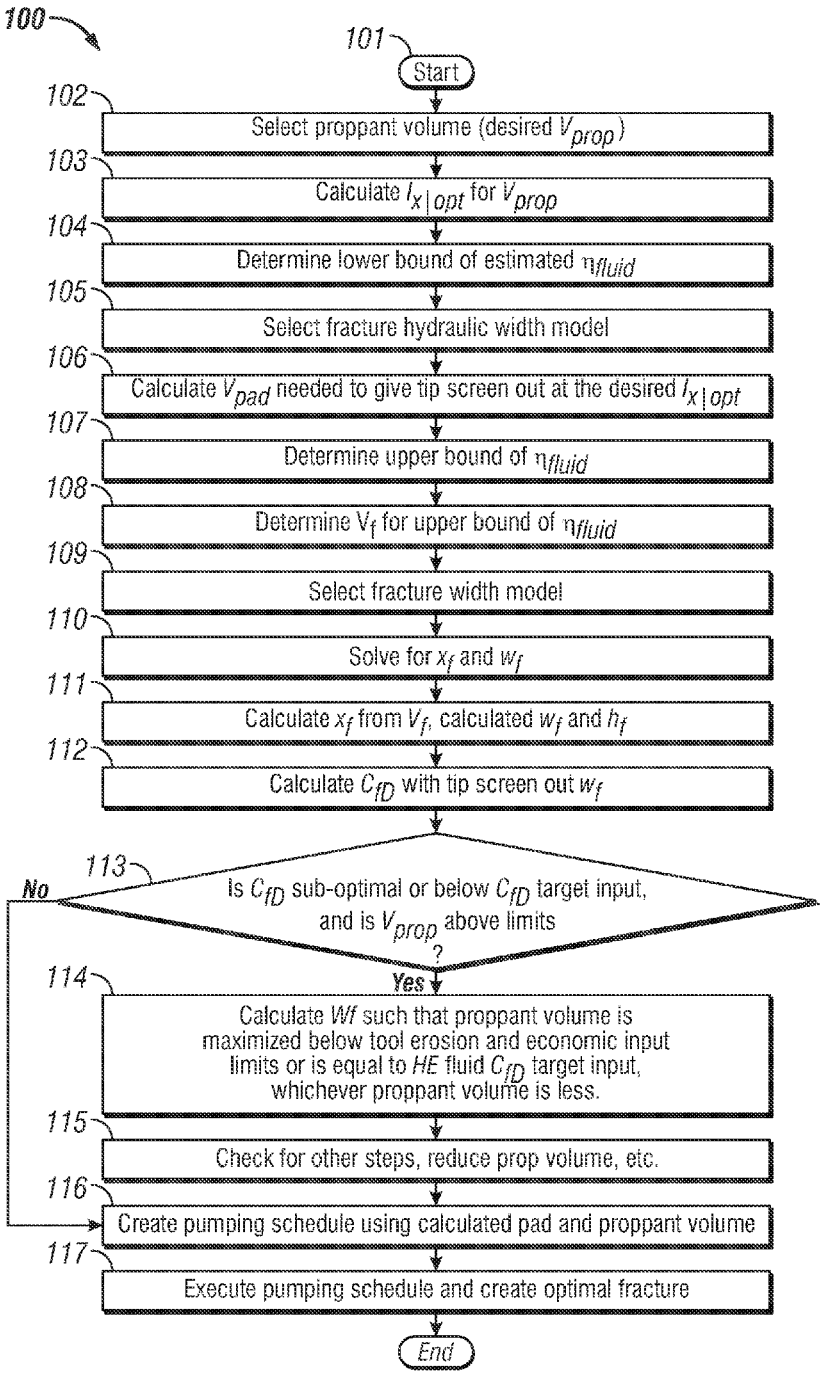
FIG. 1 is a flowchart of a method of creating improved propped fracture geometry in accordance with a particular embodiment of the present invention.

FIG. 1 illustrates a flowchart 100 of a method of calculating propped fracture geometry in accordance with a particular embodiment of the present invention. As shown in FIG. 1, flowchart 100 begins at start block 101. The desired fracture geometry is determined based upon an initially selected proppant volume and the known properties of the reservoir, such as the reservoir volume, formation permeability, fracture permeability, Young's modulus of the formation, pay height and/or pay depth. The initial proppant volume may be selected based on one or more criteria, as will be appreciated by those skilled in the art. In some embodiments, the user supplies the minimum selected proppant volume. The selected proppant volume may be selected, or selection may be limited based on erosion limitations of the service tool, economics, or other considerations. A subsequently calculated proppant volume may replace the initial proppant volume.

In particular embodiments, given an initial proppant volume, the desired fracture geometry may be determined from a dimensionless proppant number calculated from the effective propped fracture volume that would result from the initial proppant volume being placed in the fracture, reservoir volume, formation permeability, and fracture permeability. In particular, the dimensionless proppant number, $N_{prop}$, may be calculated as defined in equation 1:

$$N_{prop} = \frac{2V_{prop}k_f}{V_{res}k} \tag{1}$$

where $V_{prop}$ is the effective propped fracture volume that would result from the initial proppant volume being placed in the fracture, $V_{res}$ is the reservoir volume, k is the formation permeability, and $k_f$ is the fracture permeability. As such, the dimensionless proppant number is equal to twice the ratio of the propped fracture volume to reservoir volume multiplied by the fracture-to-reservoir permeability ratio. Referring again to FIG. 1, an initial proppant volume may be selected from a desired $V_{prop}$ at block 102. An appropriate value for $V_{prop}$ will be apparent to a person of ordinary skill in the art with the benefit of this disclosure. In some embodiments, $V_{prop}$ may be equal to or about 1000 lbs/ft, which is a value frequently employed in the industry. Additionally, in some embodiments, the value for $V_{prop}$ may be chosen based on, among other things, the degree of productivity enhancement desired or designed for, the pay interval thickness, the permeability of the formation to be fractured, the reservoir volume, or any of a number of other factors. As used herein, the term "selected proppant volume," refers to a value that is provided or chosen. While various considerations may be useful in selecting proppant volume, and may provide for more accurate calculations of other variables and thus productivity enhancement of the fracture, the phrase "selecting a proppant volume" does not necessarily require any particular calculation or process of determining a proppant volume.

From this dimensionless proppant number, the desired fracture geometry may be calculated. For example, for a square reservoir, the dimensionless proppant number is also equal to the dimensionless fracture conductivity, $C_{fD}$, times the square of the fracture penetration ratio, $I_x$. Optimum fracture geometry, in the form of an optimum fracture penetration ratio, $I_{x|opt}$, may be calculated by using an optimum dimensionless fracture conductivity, $C_{fD|opt}$ in place of the dimensionless fracture conductivity, $C_{fD}$. This relationship is shown below in equation 2:

$$N_{prop}=C_{fD}I_x^2 \tag{2}$$

Figure 2:
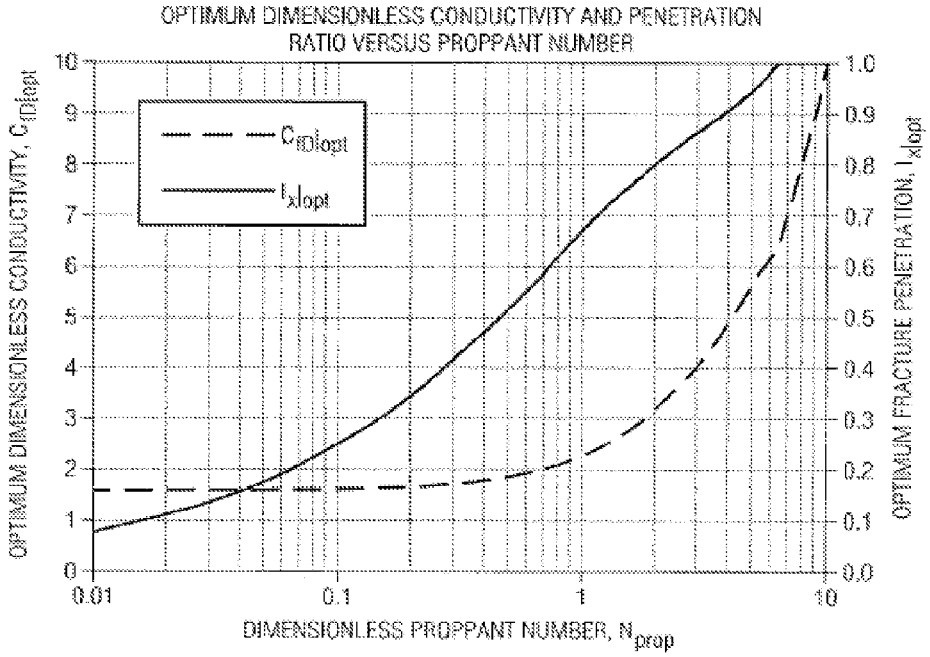
FIG. 2 is a graph illustrating the optimum dimensionless conductivity and penetration ratio versus proppant number.

Previous research has shown that for a given dimensionless proppant number, there is an optimum dimensionless fracture conductivity, $C_{fD|opt}$, and optimum fracture penetration ratio, $I_{x|opt}$. Referring again to FIG. 1, at block 103, equations 1 and 2 may be used to calculate optimal fracture geometry (e.g., $I_{x|opt}$) for the selected $V_{prop}$. FIG. 2 illustrates these values versus proppant number. Therefore, given a dimensionless proppant number, the optimum dimensionless fracture conductivity and fracture penetration ratio may be determined, for example, by calculating the corresponding dimensionless fracture conductivity and penetration ratio values or by simply looking them up in a look-up table. For example, using FIG. 2, it can be determined that for small proppant numbers (i.e., $N_{prop}<1$), the optimum dimensionless fracture conductivity is approximately 1.6. As will be appreciated by a person of ordinary skill in the art with the benefit of this disclosure, the maximum usable proppant volume for a particular fracturing operation may depend upon various factors, such as tool limitations and economic factors. In some cases, the dimensionless fracture conductivity resulting from proppant volume used due to such limitations may be in the range from about 0.05 to about 10. In other words, for a selected proppant volume, there is an optimum fracture geometry, which may be limited by factors other than optimization of volume for reservoir characteristics. These factors may cause the resulting dimensionless fracture conductivity to depend upon the obtained fracture geometry to range from 0.05 to 10. Once the optimum dimensionless fracture conductivity is determined, the relationships in equations 7 and 8 below, and $x_e$, the length of a side of a square shaped reservoir, may be used to determine the desired fracture geometry, i.e., the corresponding fracture length and width, $x_f$ and $w_f$, respectively. From these values, the fracture volume may also be determined, for example, by multiplying the fracture length and width by the pay height, which may approximate the fracture height in soft sand reservoirs and some harder reservoirs.

The amount of fracturing fluid required to create this desired fracture geometry depends on the fluid efficiency for the reservoir. This value may be difficult to accurately ascertain for a reservoir, even with extensive diagnostic pumping. Therefore, particular embodiments of the present invention rely on an estimated upper and lower bound of the fluid efficiency for the reservoir. Generally, a lower bound of fluid efficiency may be determined using a selected proppant volume. Then, based on the range of fluid efficiencies and imposed limitations, a high fluid efficiency may be calculated and can be used in the treatment pumping schedule.

A lower bound of estimated fluid efficiency ($\eta_{fluid}$) may be determined in block 104, using equation 3 below:

$$\eta_{fluid} = \frac{V_f}{V_{pumped}} \tag{3}$$

Generally, any suitable method for determining the lower bound of fluid efficiency may be used in accordance with the teachings of present invention. In particular embodiments, the lower bound may be determined based upon diagnostic testing of the reservoir in which the propped fracture is to be created. However, in other embodiments, the lower bound may be determined based upon historical values for similar reservoirs or upon an engineering estimate. The factors used to determine a lower fluid efficiency value might vary depending on what information is available. Examples of factors that may be used to determine this value include previous experience in similar reservoirs with similar permeability and temperature, reservoir characteristics together with the properties of the fracturing fluid and the expected net pressure, and/or lab test data, such as dynamic fluid loss test results obtained from using the fracturing fluid in a sample formation core. Additionally, other factors may dictate the lower fluid efficiency value, yet still give an optimized fracture treatment pumping schedule. For example, a treatment schedule may be selected for reduction in risks associated with operation of the service tool in the middle of the treatment pumping schedule. Thus, a selected proppant volume and a range of fluid efficiencies may be considered to obtain an optimum fracture for the reservoir, with or without additional constraints.

In some embodiments, an estimated lower fluid efficiency value of about 5% to about 20% may be used. In particular embodiments, 5% has proven to be a reliable estimate of the lower bound of fluid efficiency for use in accordance with the teachings of the present invention. In particular embodiments of the present invention, using such an estimate has proven as accurate as actually performing diagnostic testing. Accordingly, particular embodiments of the present invention may reduce the number of process steps, reduce gel volumes injected into the reservoir, and/or reduce damage to the productivity of the reservoir by using an estimate rather than data derived from diagnostic testing.

As will be understood by a person of ordinary skill in the art with the benefit of this disclosure, in general, the Young's modulus of the formation affects the relationship of fracture width to net pressure. For example, the Young's modulus affects the net pressure needed to achieve a designed fracture width. The net pressure in turn affects the fracturing fluid efficiency. In particular, width at the wellbore, $w_w$, may be calculated using a Khristianovich-Zheltov-Geertsma-deKlerk frac model as follows:

$$w_w = 3.22\left(\frac{\mu q x_f^2}{E h_f}\right)^{1/4} \tag{4}$$

where E is Young's modulus, μ is the apparent fluid viscosity; q is the pump rate, $x_f$ is the optimum fracture half-length, and $h_f$ is the optimum fracture height. Other equations for width include radial and the following Perkins-Kern-Nordgren frac model:

$$w_{w;0} = 3.27\left(\frac{\mu q x_f}{E}\right)^{1/4} \tag{5}$$

Referring to FIG. 1, a fracture hydraulic width model may be selected at block 105. The hydraulic fracture width at tip screen out can be used with the hydraulic fracture width to calculate the fracture volume. All the pad fluid will have leaked off into the formation at tip screen out and the proppant slurry following the pad will bridge the fracture tip and arrest fracture length growth. The pad volume is the fluid volume pumped into the fracture wherein the fracture length is equal to the optimum fracture length. The pad volume ($V_{pad}$) required to provide tip screen out at the desired optimal fracture geometry may be calculated in block 106. In particular embodiments, this may be calculated by dividing the volume of the fracture by the lower bound of the fluid efficiency and subtracting the fracture volume, as shown in equation 6 below.

$$V_{pad} = \frac{V_f}{\eta_{fluid}} - V_f \tag{6}$$

The reason for subtracting $V_f$ is because the proppant slurry displacing the pad fluid in the fracture will cause continuing fracture length growth. Thus, to set the pad volume at that required to generate the optimum length, the fracture volume at tip screen out may be subtracted. At tip screen out, the proppant has reached the tip of the fracture to stop fracture growth at the optimum length (i.e., $x_f$ in equation 7).

However, the fluid efficiency may actually be higher than the estimated lower fluid efficiency value. Accordingly, at block 107, the estimated upper bound of fluid efficiency for the reservoir may be determined. As with the estimated lower bound of fluid efficiency, any suitable method for determining the upper bound of the fluid efficiency may be used in accordance with the teachings of the present invention. In particular embodiments, the upper bound may be determined based upon diagnostic testing of the reservoir in which the propped fracture is to be created. In other embodiments, the upper bound may be determined based upon historical values for similar reservoirs or upon an engineering estimate. Factors that may be considered to determine an upper bound are similar to the factors listed for estimating a lower fluid efficiency value. In some embodiments, an estimated upper fluid efficiency value of about 10% to about 50% may be used. In some embodiments, 40% has proven to be a reliable estimate of the upper bound of fluid efficiency for use in accordance with the teachings of the present invention. Again, in particular embodiments, using such an estimate has proven as accurate as actually performing diagnostic testing. Accordingly, particular embodiments of the present invention may reduce the number of process steps, reduce gel volumes injected into the reservoir, and/or reduce damage to the productivity of the reservoir by using an estimate rather than data derived from diagnostic testing.

Using this estimated upper bound of the fluid efficiency, the fracture volume for the upper bound of fluid efficiency may be determined in block 108. Additionally, the hydraulic fracture length and width that would result from the pad volume (from block 106) being injected into the subterranean formation if the fluid efficiency of the subterranean formation was at the upper bound may be calculated in block 110, after selecting a fracture width model at block 109. In particular embodiments, this length and width are based upon the hydraulic fracture volume calculated using the relationship from equation 3. In other embodiments, the length and width may be calculated using any suitable equation(s) known in the art, such as, but not limited to, the Perkins-Kern, Perkins-Kern-Nordgren, Khristianovich-Zheltov-Geertsma-deKlerk, or Radial (Penny-shaped) width equations. Other suitable equations include the following:

$$I_x = \frac{2x_f}{x_e} \tag{7}$$

and $$C_{fD} = \frac{w_f k_f}{x_f k} \tag{8}$$

where $w_f$ is the fracture width, $x_f$ is the fracture half-length, and $x_e$ is the length of a side of a square shaped reservoir.

Referring again to FIG. 1, at block 111, the fracture width can be calculated from fracture volume, calculated fracture width, and fracture height. Then, at block 112, using the tip screen out fracture width, the dimensionless fracture conductivity may be calculated. It may be desirable to determine if the calculated fracture conductivity is sub-optimal or below the target fracture conductivity input, and the proppant volume is above the limit. Block 113 indicates that this determination may lead to additional steps.

As indicated in block 114, optionally, in some embodiments, the proppant volume may be compared to tool limitations, and reduced to or below the upper boundary of the tool limitations, if necessary. Similarly, in some embodiments, the proppant volume may be compared to economic limitations, and reduced to or below the upper economic boundary condition (e.g., savings associated with reduced rig time or expenditures associated with increased pounds of proppant). In some embodiments in which the proppant volume has been reduced, the fracture width may then be re-calculated from volumetrics of the fracture shape, using equation 8, or any suitable width equation known in the art, such as the Perkins-Kern, Perkins-Kern-Nordgren, Khristianovich-Zheltov-Geertsma-deKlerk, or Radial (Penny-shaped) width equations. When calculating this new fracture width, the fracture length calculated in block 111 may be used. According to some embodiments, a new dimensionless fracture conductivity may be calculated and compared to the optimum dimensionless fracture conductivity. Based on the variation between the two values, a decision may be made to change tooling and/or equipment so that the original proppant volume may be accommodated, or the method may proceed with the reduced proppant volume. Any such variations, steps, reductions, or adjustments may be incorporated, as indicated at block 115.

As indicated in block 116, a pumping schedule may be created using calculated pad and proppant volumes. In some embodiments, the proppant volume (or a reduced proppant volume), and the pad volume calculated in block 106, are then used to execute the pumping schedule and create one or more optimal fractures in the subterranean formation, as indicated in block 117. In particular embodiments, this may be accomplished by inputting these amounts to any suitable ramp schedule and injecting them into a subterranean formation at a pressure sufficient to create or enhance at least one fracture therein. Factors to be considered in selecting a ramp schedule will be apparent to a person of ordinary skill in the art with the benefit of this disclosure.

Figure 3:
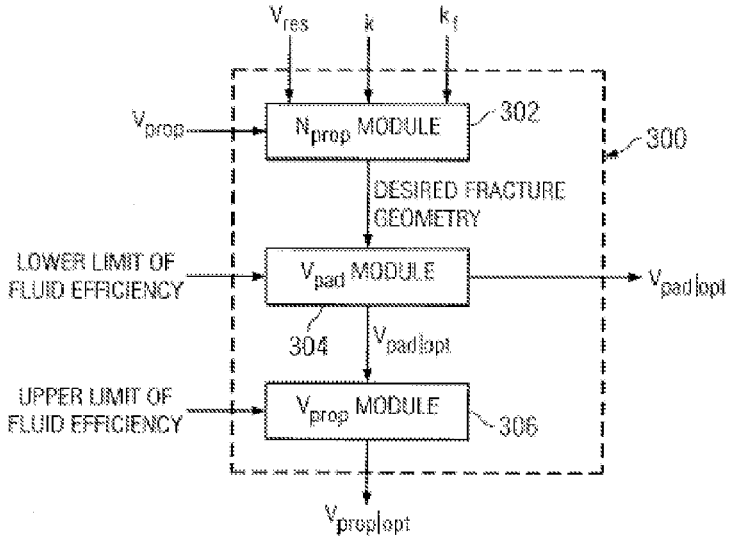
FIG. 3 is an illustration of a system for calculating improved fracture geometry in accordance with a particular embodiment of the present invention.

A better understanding of the present invention may be had by making reference to FIG. 3, which illustrates a system 300 for calculating propped fracture geometry in accordance with a particular embodiment of the present invention. As shown in FIG. 3, system 300 comprises $N_{prop}$ module 302, $V_{pad}$ module 304, and $V_{prop}$ module 306. Generally, $N_{prop}$ module 302 calculates the dimensionless proppant number and desired fracture geometry, $V_{pad}$ module 304 calculates the pad volume necessary to create the desired fracture geometry, and $V_{prop}$ module 306 calculates proppant volume necessary to create the desired fracture geometry. In particular embodiments of the present invention, each of these modules may be implemented using any combination of computer hardware and/or software.

As mentioned above, $N_{prop}$ module 302 calculates the dimensionless proppant number for a given proppant volume. $H_{prop}$ module 302 receives the propped fracture volume, reservoir volume, formation permeability, and fracture permeability as an input and calculates the corresponding dimensionless proppant number from equation 1 above. Module 302 then calculates the optimum dimensionless fracture conductivity and optimum fracture penetration ratio corresponding to the dimensionless proppant number. In particular embodiments, module 302 may calculate these values on-the-fly. In other embodiments, module 302 may simply retrieve the values from a look-up table (not illustrated). From the optimum dimensionless fracture conductivity, module 302 then calculates the desired fracture length and width using equation 8 above. From these values, module 302 then calculates the desired fracture volume, which is then passed to $V_{pad}$ module 304.

System 300 also includes $V_{pad}$ module 304. $V_{pad}$ module 304 calculates the pad volume required to create the desired fracture geometry. $V_{pad}$ module 304 receives the desired fracture volume from module 302 and the estimated lower bound of fluid efficiency as inputs. As discussed above, in particular embodiments, the estimated lower bound of fluid efficiency may be based upon diagnostic pumping, historical values for similar reservoirs, an engineering estimate, or an operator-determined value. Module 304 then calculates the pad volume sufficient to create the desired fracture geometry at tip screen out based on the geometry received from module 302. In particular embodiments, this is calculated by dividing the volume of the fracture at tip screen out by the estimated lower bound of the fluid efficiency, and then subtracting the fracture volume, since the fracture can continue to grow as the proppant stages displace the pad and it leaks off into the formation fracture faces and tip. This pad volume is then passed to $V_{prop}$ module 306.

Finally, $V_{prop}$ module 306 receives the pad volume from module 304 and the estimated upper bound of fluid efficiency as inputs. As discussed above, in particular embodiments, the estimated upper bound of fluid efficiency may be based upon diagnostic pumping, historical values for similar reservoirs, an engineering estimate, or an operator-determined value. Module 306 then calculates the fracture length that would result from the pad volume calculated by module 304 assuming the fluid efficiency is equal to its estimated upper bound. From this fracture length value, and a fracture width value calculated to get a selected fracture conductivity or to hit a low proppant limit, module 306 then determines the corresponding volume of proppant to achieve the dimensionless fracture conductivity, which may be determined by an input imposed limit, provided as an input. Module 306 then outputs the calculated proppant volume. The proppant volume output by module 306 and pad volume output by module 304 may then be used in a suitable fracturing schedule to create the desired propped fracture geometry in the subterranean formation.

Systems and methods in accordance with particular embodiments of the present invention may result in improved propped fracture geometry relative to previous hydraulic fracturing treatments. Moreover, particular embodiments of the present invention may be able to achieve these improved propped fracture geometries without relying on extensive diagnostic testing of the subterranean formation. Although, diagnostic testing may be used to supply information used in accordance with the teachings of the present invention, some embodiments of the present invention need not rely on such diagnostic testing. For example, by using estimates of the upper and lower bounds of fluid efficiency, particular embodiments of the present invention are able to eliminate or reduce some diagnostic testing. This helps eliminate process steps in the hydraulic fracturing treatment, saving time and/or expense. Additionally, the elimination or reduction of diagnostic testing may help reduce gel volumes injected into the reservoir, and/or reduce damage to the productivity of the reservoir.

For example, in a particular embodiment, the present invention provides a method of fracturing a subterranean formation comprising selecting a proppant volume for placement in a fracture to be created in a subterranean formation, determining a desired fracture geometry for the fracture, calculating a pad volume sufficient to create the desired fracture geometry in the subterranean formation at a lower fluid efficiency value, solving for a fracture length that would result from injecting the pad volume into the subterranean formation at an upper fluid efficiency value, solving for a fracture width that corresponds to the obtained fracture length, calculating a proppant volume sufficient to achieve the optimum or the selected dimensionless fracture conductivity or to reach proppant volume limits imposed, and creating a fracture in the subterranean formation using the calculated pad and proppant volumes. In some embodiments, a fracture is created by injecting the calculated pad and proppant volumes into the subterranean formation at a pressure sufficient to create or enhance at least one fracture therein.

In another embodiment, the present invention provides logic encoded in computer-readable media operable, when executed by one or more processors, to perform the steps comprising selecting an initial proppant volume for placement in a fracture to be created in a subterranean formation, determining a desired fracture geometry for the fracture, calculating a pad volume sufficient to create the desired fracture geometry in the subterranean formation at a lower fluid efficiency value, calculating a fracture length and width that would result from injecting the pad volume into the subterranean formation at an upper fluid efficiency value, and calculating a proppant volume sufficient to fill a fracture having the calculated length and width to achieve the optimum or selected dimensionless fracture conductivity or to reach proppant volume limits imposed.

In yet another embodiment, the present invention provides a system for calculating propped fracture geometry, comprising a proppant number module operable to determine a desired fracture geometry for a fracture in a subterranean formation, a pad volume module operable to calculate a pad volume sufficient to create the desired fracture geometry in the subterranean formation at an estimated lower fluid efficiency value, and a proppant volume module operable to calculate a proppant volume sufficient to fill a fracture created in the subterranean formation that would result from the calculated pad volume being injected into the subterranean formation if the subterranean formation had a fluid efficiency value equal to an estimated upper fluid efficiency value, and obtain the optimum or selected or imposed fracture conductivity.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

What is claimed is:

1. A method of determining a pad volume and a proppant volume for fracturing a subterranean formation comprising:

selecting an initial proppant volume for placement in a fracture to be created in the subterranean formation;

determining a fracture geometry for the fracture, based upon the initial proppant volume;

determining a pad volume sufficient to create the desired fracture geometry at a first fluid efficiency value;

determining a fracture length and width that would result from injecting the pad volume into the subterranean formation at a second fluid efficiency value; and calculating a proppant volume sufficient to fill a fracture having the length and width; wherein the first fluid efficiency value is lower than the second fluid efficiency value; and, creating a propped fracture within a subterranean formation using a fluid comprising the calculated pad volume and a proppant volume equal to or less than the calculated proppant volume.

2. The method of claim 1, wherein determining the fracture geometry comprises:

calculating a dimensionless proppant number based upon the initial proppant volume, a reservoir volume, a fracture permeability, and a formation permeability;

determining a dimensionless fracture conductivity value corresponding to the dimensionless proppant number; and calculating the fracture geometry corresponding to the dimensionless fracture conductivity value.

3. The method of claim 1, wherein the desired fracture geometry comprises a desired fracture length at a coincidence of a tip screen out of following proppant laden stages.

4. The method of claim 1, wherein determining the fracture length comprises calculating the fracture length, specifying an optimum length, providing the fracture length based on a specified fracture conductivity, or a combination thereof.

5. The method of claim 1, wherein determining a fracture width comprises calculating the fracture width, specifying an optimum width, providing the fracture width based on a specified fracture conductivity, or a combination thereof.

6. The method of claim 1, wherein the dimensionless fracture conductivity value is the initial proppant volume, an optimum proppant volume, or an input parameter limited proppant volume.

7. The method of claim 1, wherein determining the pad volume comprises:

determining the first fluid efficiency value; and calculating the pad volume sufficient to create the desired fracture geometry at the first fluid efficiency value.

8. The method of claim 1, wherein determining the fracture length and width comprises:

determining the second fluid efficiency value; and, calculating the fracture length and width that would result from injecting the pad volume into the subterranean formation at the second fluid efficiency value.

9. The method of claim 8, wherein calculating the fracture length and width comprises:

calculating a fracture volume that would result from the pad volume being injected into the subterranean formation at the second fluid efficiency value;

calculating the fracture length corresponding to the fracture volume at tip screen out; and calculating the fracture width corresponding to the fracture length based upon an equation selected from the group consisting of the dimensionless fracture conductivity equation, Perkins-Kern width equation, Perkins-Kern-Nordgren width equation, Khristianovich-Zheltov-Geertsma-deKlerk equation, and Radial width equation.

10. Logic encoded in non-transitory computer-readable media encoded with a computer program containing instructions stored therein for causing one or more computer processors, to perform the steps comprising:

selecting an initial proppant volume for placement in a fracture to be created in a subterranean formation;

determining a fracture geometry for the fracture;

determining a pad volume sufficient to create the fracture geometry at a first fluid efficiency value;

determining a fracture length and width that would result from injecting the pad volume into the subterranean formation at a second fluid efficiency value; and calculating a proppant volume sufficient to fill a fracture having the length and width such that the resulting fracture conductivity is either the initial proppant volume, an optimum proppant volume, or an input parameter limited proppant volume;

wherein the first fluid efficiency value is lower than the second fluid efficiency value.

11. The logic of claim 10, wherein determining the fracture geometry comprises:

calculating a dimensionless proppant number based upon the initial proppant volume, a reservoir volume, a fracture permeability, and a formation permeability;

determining a dimensionless fracture conductivity value corresponding to the dimensionless proppant number; and calculating a fracture geometry corresponding to the dimensionless fracture conductivity value.

12. The logic of claim 10, wherein determining the pad volume comprises:

determining the first fluid efficiency value; and calculating the pad volume sufficient to create the desired fracture geometry at the first fluid efficiency value.

13. The logic of claim 10, wherein determining the fracture length and width comprises:

determining the second fluid efficiency value;

calculating the fracture length that would result from injecting the pad volume into the subterranean formation at the second fluid efficiency value; and calculating the fracture width corresponding to the fracture length at tip screen out.

14. The logic of claim 13, wherein calculating the fracture length and width comprises:

calculating a fracture volume that would result from the pad volume being injected into the subterranean formation at the second fluid efficiency value; and calculating the fracture length corresponding to the fracture volume at tip screen out; and calculating the fracture width corresponding to the fracture length based upon an equation selected from the group consisting of the dimensionless fracture conductivity equation, Perkins-Kern width equation, Perkins-Kern-Nordgren width equation, Khristianovich-Zheltov-Geertsma-deKlerk equation, and Radial width equation.

15. A system for calculating propped fracture geometry, comprising:

a proppant number module operable to determine a fracture geometry for a fracture in a subterranean formation;

a pad volume module operable to calculate a pad volume sufficient to create the fracture geometry at a first fluid efficiency value; and a proppant volume module operable to calculate a proppant volume sufficient to fill a fracture that would result from the calculated pad volume being injected into the subterranean formation at a second fluid efficiency value and obtain a fracture width;

wherein the first fluid efficiency value is lower than the second fluid efficiency value.

16. The system of claim 15, wherein the proppant number module is operable to calculate a dimensionless proppant number for the fracture based upon an initial proppant volume, a reservoir volume, a fracture permeability, and a formation permeability.

17. The system of claim 16, wherein the proppant number module is operable to determine a dimensionless fracture conductivity value corresponding to the dimensionless proppant number.

18. The system of claim 17, wherein the dimensionless fracture conductivity value is either the initial proppant volume, an optimum proppant volume, or an input parameter limited proppant volume.

19. The system of claim 15, wherein the proppant volume module is operable to:

calculate a fracture volume that would result from the pad volume being injected into the subterranean formation at the second fluid efficiency value;

calculate a fracture length corresponding to the fracture volume at tip screen out; and calculate the fracture width corresponding to the calculated fracture length using an equation selected from the group consisting of the dimensionless fracture conductivity equation, Perkins-Kern width equation, Perkins-Kern-Nordgren width equation, Khristianovich-Zheltov-Geertsma-deKlerk equation, and Radial width equation.

20. The system of claim 15, such that the dimensionless fracture conductivity is either the initial proppant volume, an optimum proppant volume, or an input parameter limited proppant volume.

* * * * *